US005690190A

United States Patent [19]

Rivera

[11] Patent Number: 5,690,190

[45] Date of Patent: Nov. 25, 1997

[54] OVERLAY FOR AN ELEVATOR GUIDE RAIL

[75] Inventor: James A. Rivera, Bristol, Conn.

[73] Assignee: Otis Elevator Company, Farmington, Conn.

[21] Appl. No.: 676,011

[22] Filed: Jul. 5, 1996

Related U.S. Application Data

[62] Division of Ser. No. 491,003, Jun. 15, 1995.

[51] Int. Cl.[6] ..... B66B 7/02

[52] U.S. Cl. ..... 187/406; 104/106

[58] Field of Search ..... 187/406, 401, 187/409, 410, 414; 104/106, 111

[56] References Cited

FOREIGN PATENT DOCUMENTS 7206316 8/1995 Japan .

*Primary Examiner*—Kenneth Noland

[57] ABSTRACT

An overlay for a elevator guide rail extends over the joints between segments to provide a seamless engagement surface for the guide rail. The overlay separates the engagement surface from the joints between adjacent segments to minimize vibration and improve the comfort of the ride. In one embodiment, an elevator includes a guide rail having a support formed from multiple segments joined end to end and an overlay encompassing a portion of the support. The overlay defines the engagement surface for the guide shoes of the elevator.

8 Claims, 1 Drawing Sheet

OVERLAY FOR AN ELEVATOR GUIDE RAIL

This is a division of copending application Ser. No. 08/491,003 filed on Jun. 15, 1995.

TECHNICAL FIELD

The present invention relates to elevators, and more particularly to guide rails for such elevators.

BACKGROUND OF THE INVENTION

Elevators are well known as efficient and effective methods to transport people. Much of the recent development in elevators has focused on improving the comfort level of the passengers on the elevator while at the same time minimizing the cost of the elevator. A significant portion of the cost is the expenses related to maintaining the elevator such that it continues to operate efficiently and effectively.

The basic elevator system includes a car frame raised and lowered within a hoistway. The motive force for the movement may be supplied by an electric motor engaged with the car frame via a roping arrangement, by a hydraulic power supply engaged with the car frame via a hydraulic column, or by a linear motor. In practically all configurations, the car frame is guided through the hoistway by a pair of guide rails that extend along the side of the car frame. The car frame includes a pair of devices engaged with each guide rail, either of the roller type or of the sliding guide type device. It is the engagement of these devices with the guide rail that determines the path of motion of the car frame within the hoistway.

As a result of the extended length of the hoistway, the guide rails are formed from multiple segments mated end to end. Joints or splices are required between adjacent segments. During operation of the elevator, the rollers or sliding guides contact these joints, which causes vibration of the car frame. To minimize the car frame vibration resulting from the joints, and thereby the comfort of the passengers riding in the elevator car, the segments are premachined and aligned as precisely as practical during installation. Over time, however, the segments may become misaligned due to the settling of the building, movement of the building, or thermal expansion differences.

In addition to guiding the motion of the elevator, in some cases the guide rails also provide a surface for the elevator safeties to engage. The engagement of the safeties and the guide rails is sufficient to quickly and safely stop the elevator car. A consequence of this type of action, however, is the possibility of damaging the contact surface of the guide rails such that the guide rail has to be remachined or replaced. Replacing the guide rail involves removing the damaged guide rail segment, or segments, installing the new segments, and aligning the new segments with the previously installed segments. The cost of this maintenance operation is significant. Further, the ability to accurately predict the stopping distance is made difficult as a result of the need to lubricate the rails. Lubrication is necessary to reduce friction between the rails and guide shoes.

The above art notwithstanding, scientists and engineers under the direction of Applicant's Assignee are working to develop a seamless guide rail that optimizes the comfort of the ride for the passengers and minimize the cost of maintaining the elevator.

DISCLOSURE OF THE INVENTION

According to the present invention, an overlay for a guide rail extends over a plurality of the segments forming the guide rail and includes the engagement surface for the elevator.

An advantage of the overlay is a smoother ride for the passengers riding on the elevator. The overlay covers the joints between segments and thereby eliminates the joints from the engagement surface between the elevator and the guide rail. The engagement surface produced by using the overlay is a smooth, continuous surface without interruptions that may generate unwanted vibration in the elevator. Another advantage of the overlay is the ease and inexpensive manner in which the engagement surface may be replaced in the event of undue wear or damage. Only the overlay needs to be removed and replaced; the underlying structural segments of the guide rail may be left in place. A further advantage is that minor misalignments between guide rail joints that occur due to building settling, movements, or thermal expansion, do not require the guide rails to be realigned.

In addition to the above cited features and advantages, a self-lubricating material may be selected for the overlay that reduces the cost of maintaining the guide rails. With a self-lubricating, high density polymer with a low coefficient of friction as the overlay, the need to manually lubricate the engagement surface between the guide shoes and the guide rail is eliminated.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
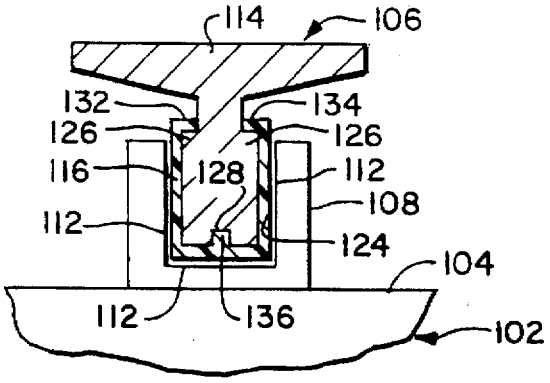
FIG. 1 is an elevator guide rail having an overlay.
Figure 2:
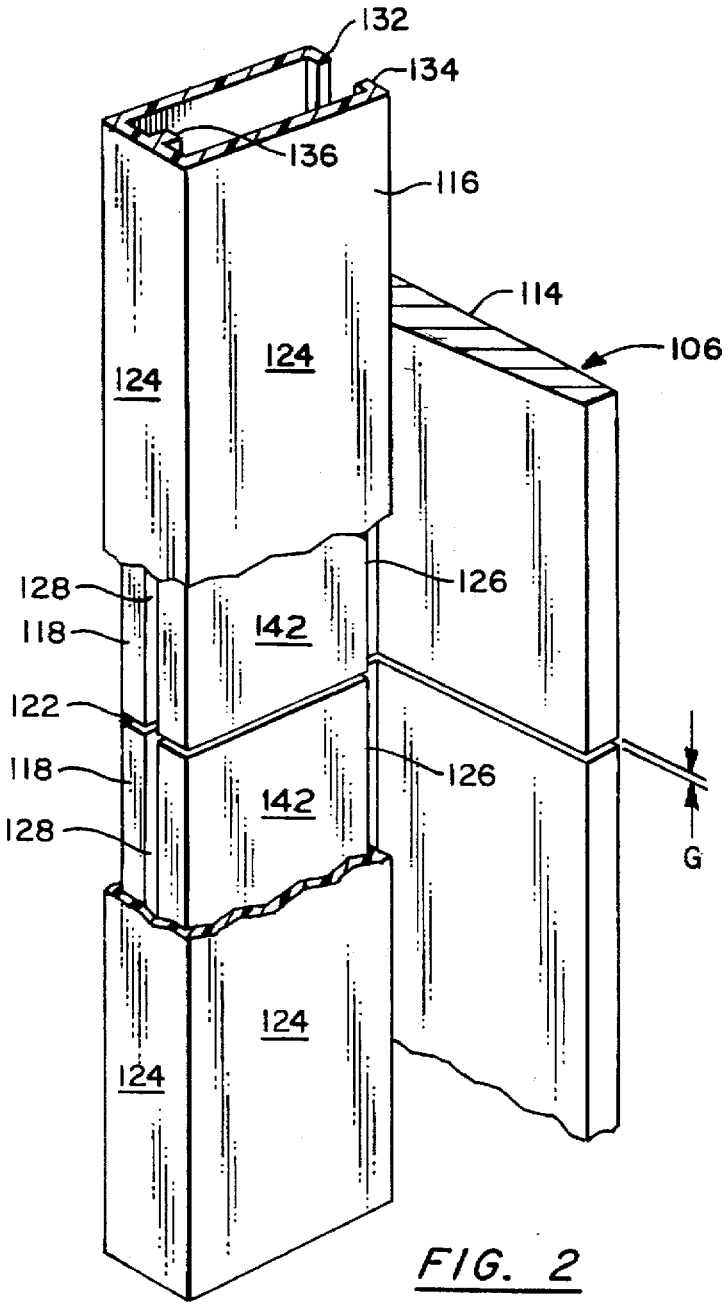
FIG. 2 is a perspective view of a portion of the elevator guide rail with the joints between adjacent guide rail segments shown.

FIGS. 1 and 2 illustrate one embodiment of the present invention. An elevator 102 includes a car frame 104 engaged with a pair of guide rails 106 disposed on opposite sides of the car frame (only one of which is shown in FIG. 3). As is well known, the car frame 104 supports a platform for bearing passengers or other types of loads. The car frame 104 includes a plurality of U-shaped guide shoes 108 (only one of which is shown) having surfaces 112 that are in close proximity to the guide rails 106.

The guide rails 106 extend through the hoistway and define the path of travel of the car frame. Each of the guide rails 106 includes a T-shaped support 114 and an overlay 116. The T-shaped support 114 is comprised of a plurality of segments 118 mated end to end to form joints or splices 122 between adjacent segments 118. The overlay 116 extends about a portion of the support 114 and provides the engagement surface 124 of the guide rail 106 for sliding contact between the surfaces 112 of the guide shoes 108 and the guide rail 106. As shown in FIG. 2, the overlay 116 extends over the plurality of segments 118 to separate the engagement surface 124 from the segments 118 and the joints 122. In this way, the guide shoes 108 do not engage the joints 122 directly during the sliding of the guide shoes 108 over the guide rails 106.

In addition, since the overlay 116 provides the engagement surface 124 for the guide shoes 108, a substantial gap "G" may be used between adjacent segments 118. The gap "G" is sized to permit thermal expansion of the segments 118 and other movements of the building with minimal risk of interference at the joint 122. Such interference, if it occurs, may cause the guide rails 106 to buckle and become misaligned. In prior art guide rails, a gap introduces a discontinuity in the engagement surface for the guide rails.

The support 114 includes a pair of ridges 126 and a groove 128. Each of the ridges 126 is positioned and shaped to engage with one of a pair of opposing hooks 132,134 on the overlay 116. The groove 128 extends longitudinally along the outer edge of the support 114 and is shaped to receive a complementary shaped tongue 136 extending from the inner surface of the overlay 116. The cooperation of the hooks 132,134 and ridges 126 and the tongue 136 and groove 128 retains the overlay 116 to the support in a manner preventing misalignment of the overlay 116 relative to the support 114.

To install the overlay 116 onto the support 114, the overlay 116 slides over the lateral surfaces 142 of the support 114 until the hooks 132,134 are proximate to the ridges 126. The tongue 136 is aligned with the groove 128 and the overlay 116 is then urged further onto the support 114 until the hooks 132,134 snap into engagement with the ridges 126. The installation may be done progressively along the length of the support 114. As with the overlay 176 of FIGS. 1 and 2, it should be obvious to those skilled in the an that other methods of installing and retaining the overlay 116 to the support 114 may be used. The snap fit type configuration facilitates the installation and replacement of the overlay 116.

The overlay 116 eliminates the need to machine the surfaces of the support segments to provide the engagement surface. As a result, the support segments 118 may be formed from extruded aluminum to reduce weight and to improve the handleability of the segments during construction of the hoistway and installation of the segments.

The overlay 116 may be formed by extruding a material providing a wear resistant surface for the engagement surface. Suggested materials include ultra high molecular weight polyethylene (UHMW), polyetheretherketone (PEEK), or other high density plastics that have high bearing and wear characteristics. The suggested materials may be formed into the desired shape by extrusion and facilitate handling during installation, removal and replacement of the overlay. An additional benefit of the suggested materials for the overlay is that such materials provide a softer contact surface than steel and may provide some dampening of the contact between the guide shoes and the guide rail to cushion the ride of the passengers. As an alternative, the overlay 116 may be formed from a metallic composite such as stainless steel.

In addition, the material selected to provide the engagement surface 124 may also be impregnated with lubrication to provide a self-lubricating contact surface. The additional benefit of this embodiment is the elimination of the requirement of micro-machine finishing and lubricating the engagement surface 124 for the sliding engagement with the guide shoes.

Although the elevator illustrated in FIGS. 1 and 2 is of the type having guide shoes engaged with the guide rail, the invention also has application to elevators of the type having roller guides engaged with the guide rails. In this configuration, the rollers of the roller guides would engage in rolling contact with the engagement surface of the overlay.

The embodiments illustrated in FIGS. 1–2 show a single layer overlay extending over a guide rail. The overlay may also be formed from multiple layers that extend over the guide rail. In this way, the outermost layer may be optimized for durability to withstand the wearing contact with the rollers or guide shoes with an intermediate layer or layers optimized to provide other benefits, such as damping. In addition, the overlays of FIGS. 1–2 are shown and described as extending over the entire length of the support structure or support. In some applications this length of overlay may not be practical. In this instance, multiple overlays mated end to end may be used to extend over the total length of the support structure. Although this embodiment may introduce some joints between adjacent overlays, the number of joints will be reduced and the other benefits, such as ease of installation, removeability, and damping will still be realized.

Although the invention has been shown and described with respect to exemplary embodiments thereof, it should be understood by those skilled in the art that various changes, omissions, and additions may be made thereto, without departing from the spirit and scope of the invention.

What is claimed is:

1. A method to install a guide rail for a elevator, the elevator including a platform for bearing passengers, the platform moving through a path defined by engagement between the platform and the guide rail, the guide rail including a plurality of segments adapted to be joined sequentially and an overlay, the overlay having an engagement surface for the platform, the method including the steps of:

joining the plurality of segments sequentially, such that a plurality of joints between adjacent segments are thereby formed;

attaching the overlay to the plurality of joined segments, the overlay extending over the plurality of segments and joints.

2. The method according to claim 1, wherein the overlay includes a hook extending therefrom, wherein one or more of the segments includes a ridge having a shape complementary to the hook and adapted to engage the hook to retain the overlay to the plurality of segments, and wherein the step of attaching the overlay to the plurality of joined segments includes engaging the hook with the ridge.

3. The method according to claim 2, wherein the overlay further includes a tongue extending therefrom, wherein each of the segments further include a groove adapted to receive the tongue, and wherein the step of attaching the overlay to the plurality of joined segments includes engaging the tongue with the plurality of grooves.

4. The method according to claim 2, wherein the overlay includes a second hook extending therefrom, wherein the one or more of the plurality of segments further includes a second ridge having a shape complementary to the second hook and adapted to engage the second hook, and wherein the step of attaching the overlay to the plurality of joined segments includes urging the hooks into engagement with the complementary ridges such that the overlay is snap-fit onto the plurality of joined segments and retained by the engagement of the hooks and the ridges.

5. A method to replace the engagement surface for the engagement between a guide rail of a elevator and a passenger bearing platform of the elevator, the guide rail including a plurality of segments adapted to be joined sequentially and a first overlay, the first overlay having the engagement surface for the platform and being removable attached to the plurality of joined segments, the method including the steps of:

removing the first overlay attached to the plurality of joined segments; and attaching a second overlay to the plurality of joined segments, the second overlay including the replacement engagement surface.

6. The method according to claim 5, wherein the overlays include a hook extending therefrom, wherein one or more of the segments includes a ridge having a shape complementary to the hooks and adapted to engage the hooks to retain the overlays to the plurality of segments, wherein the step of removing the first overlay includes disengaging the hook of the first overlay from the ridge, and wherein the step of attaching the second overlay to the plurality of joined segments includes engaging the hook with the ridge.

7. The method according to claim 6, wherein the overlays further include a tongue extending therefrom, wherein each of the segments further include a groove adapted to receive the tongues, wherein the step of removing the first overlay includes disengaging the tongue of the first overlay from the grooves, and wherein the step of attaching the second overlay to the plurality of joined segments includes engaging the tongue of the second overlay with the plurality of grooves.

8. The method according to claim 6, wherein the overlays include a second hook extending therefrom, wherein the one or more of the plurality of segments further includes a second ridge having a shape complementary to the second hooks and adapted to engage the second hooks,-and wherein the step of attaching the overlay to the plurality of joined segments includes urging the hooks into engagement with the complementary ridges such that the overlay is snap-fit onto the plurality of joined segments and retained by the engagement of the hooks and the ridges.

* * * * *